US010844634B1

(12) United States Patent
Coleman

(10) Patent No.: US 10,844,634 B1
(45) Date of Patent: Nov. 24, 2020

(54) GATE LOCK

(71) Applicant: Jack Clinton Coleman, Choudrant, LA (US)

(72) Inventor: Jack Clinton Coleman, Choudrant, LA (US)

( * ) Notice: Subject to any disclaimer, the term of this patent is extended or adjusted under 35 U.S.C. 154(b) by 472 days.

(21) Appl. No.: 15/823,910

(22) Filed: Nov. 28, 2017

Related U.S. Application Data

(60) Provisional application No. 62/426,798, filed on Nov. 28, 2016.

(51) Int. Cl.
*E05B 65/00* (2006.01)
*E05C 1/10* (2006.01)

(52) U.S. Cl.
CPC ..... *E05B 65/0007* (2013.01); *E05C 1/10* (2013.01)

(58) Field of Classification Search
CPC ..... E05B 65/0007; E05B 67/383; E05B 15/0205; E05B 15/02; Y10T 292/37; Y10T 70/5637; Y10S 70/63; A01K 1/0017; E05Y 2900/40
See application file for complete search history.

(56) References Cited

U.S. PATENT DOCUMENTS 3,889,497 A * 6/1975 Tuttle ..... E05B 35/08 70/14
3,988,031 A * 10/1976 Meyer ..... E05B 67/383 292/153
4,697,443 A * 10/1987 Hillin ..... E05B 35/08 292/205
4,997,219 A * 3/1991 Carter ..... E05B 35/08 292/148
9,206,629 B1 * 12/2015 Olschewsky ..... E05C 3/145
2008/0264116 A1 * 10/2008 McNeil ..... E05B 67/383 70/20

* cited by examiner

*Primary Examiner* — Mark A Williams
(74) *Attorney, Agent, or Firm* — Jones Walker LLP

(57) ABSTRACT

A gate lock for locking single drive or double drive gates includes a mounting bracket, a faceplate, a locking pin and a latch bar. The mounting bracket is connected to a first fence portion while the latch bar is connected to the second fence portion. The faceplate is connected to the mounting bracket through the use of a fastener positioned within the faceplate's central aperture. The faceplate is capable of being rotated about the central aperture. The faceplate includes locking apertures for receiving padlocks. The faceplate, mounting bracket, and latch bar each include apertures for receiving the locking pin. The faceplate and the latch bar can each include a plurality of apertures for receiving the locking pin. In the locked position, the latch bar is positioned between the mounting bracket and the first fence portion, the locking pin is positioned within the locking aperture of the latch bar, and the faceplate has a padlock positioned within each locking aperture. In the unlocked position, at least one locking aperture of the faceplate does not have a padlock, the locking pin is positioned within the locking aperture of the faceplate, and the latch bar can be removed from between the mounting bracket and the first fence portion. The gate lock is actuated between a locked and unlocked position through the sliding of the locking pin's handle within the slot on the mounting bracket.

13 Claims, 9 Drawing Sheets

GATE LOCK

CROSS-REFERENCE TO RELATED APPLICATIONS

This application claims the benefit of U.S. Provisional Application No. 62/426,798, filed Nov. 28, 2016, which is hereby incorporated by reference.

BACKGROUND OF THE INVENTION

This invention relates to locks and latches for gates. More particularly, this invention relates to locks and latches used to secure a gate to a post, or to secure a gate to another gate. Further, particular embodiments of this invention relate to gate locks and latches which are accessible by individual users, each having a different key.

There are many forms of gate locks and latches. Property protected by a fence is often accessible only through a lockable gate. Often it is necessary to provide for secure access by multiple users, each having a different key. Prior art gate locks have provided locking mechanisms whereby a locking rod slides into and out of engagement with a post or an opposite gate. The locking rod may be withdrawn from its locked position by sliding it through an aperture in the lock mechanism on the gate. Multiple such apertures can be provided. A locking device, such as a padlock, can be locked to such aperture with the locking arm of the padlock passing through and blocking the aperture, thus preventing the locking rod from disengaging with the post or opposite gate. Once such device is disclosed in U.S. Pat. No. 4,997,219.

However, locking devices having locking rods slidably extending to a post or opposite gate must be alignable with an opening on the post or opposite gate. Very often a gate will sag, settle, become damaged, or otherwise become misaligned with the post or opposite gate. When this happens, the locking rod often cannot be aligned in a locked position. A gate lock is needed which can be accessed and locked by multiple users with different keys, and which can be locked when the gate position changes relative to the post or opposite gate.

SUMMARY OF SELECTED EMBODIMENTS OF THE INVENTION

One embodiment of the present invention includes a gate lock for locking single drive or double drive gates. The gate lock includes a mounting bracket, a faceplate, a locking pin and a latch bar. The mounting bracket is connected to a first gate or fence portion while the latch bar is connected to the second gate or fence portion. The faceplate is connected to the mounting bracket through the use of a fastener positioned within the faceplate's central aperture and is capable of being rotated about the central aperture. The faceplate, mounting bracket, and latch bar each include apertures for receiving a locking pin. In the locked position, the latch bar is positioned between the mounting bracket and the first gate or fence portion, the locking pin is positioned within the locking aperture of the latch bar, and the faceplate has a padlock positioned within each locking aperture. In the unlocked position, at least one locking aperture of the faceplate does not have a padlock, the locking pin is positioned within the locking aperture of the faceplate, and the latch bar can be removed from between the mounting bracket and the first gat or fence portion.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to illustrate further various embodiments and to explain various principles and advantages in accordance with the gate lock described herein. Advantages of embodiments of the gate lock will be apparent from the following detailed description of the exemplary embodiments thereof, which should be considered in conjunction with the accompanying drawings in which.

DETAILED DESCRIPTION OF THE INVENTION

Figure 1:
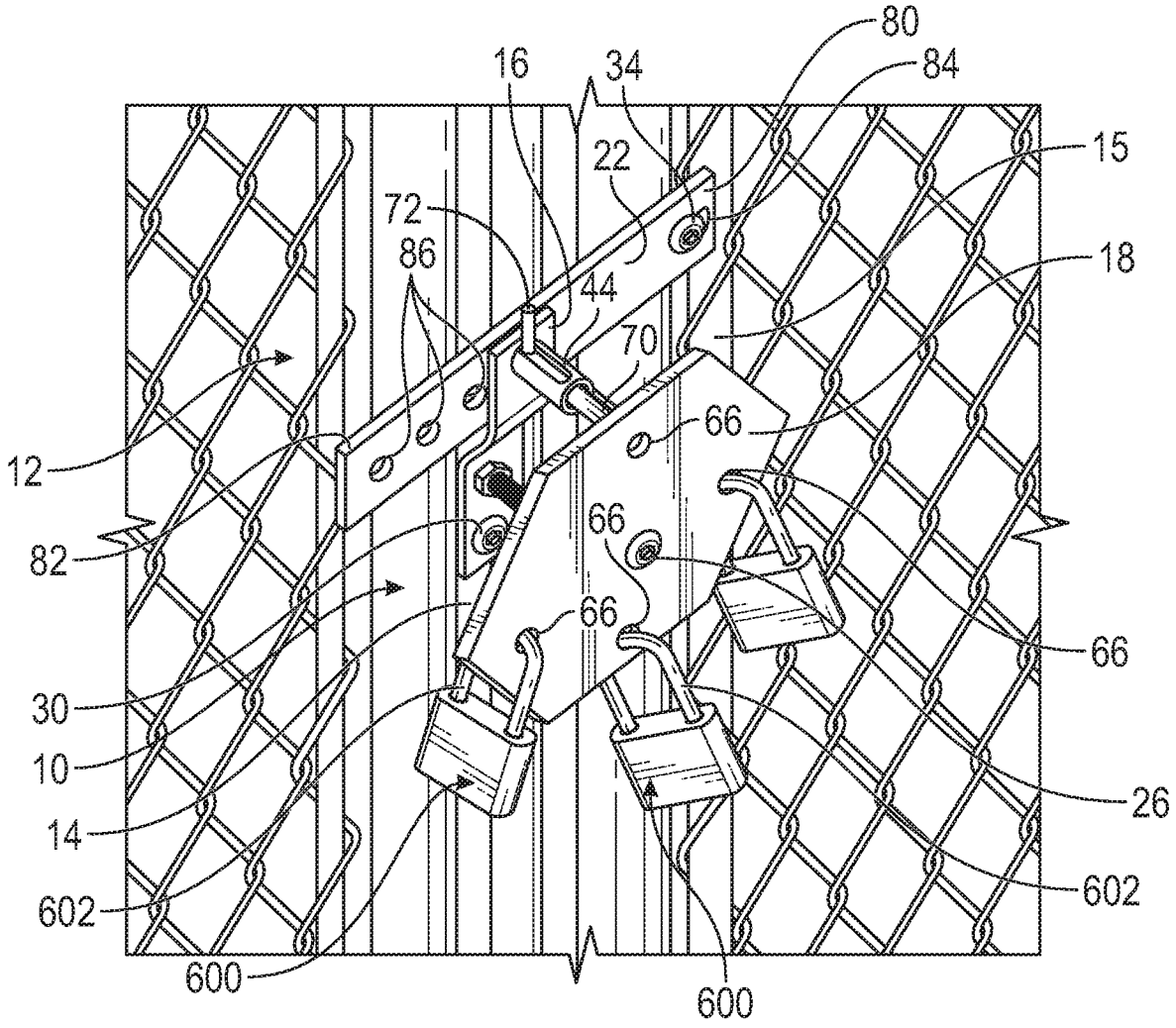
FIG. 1 is a perspective view of one embodiment of the gate lock.

Detailed embodiments of the gate lock are disclosed herein; however, it is to be understood that the disclosed embodiments are merely exemplary and the gate lock can be embodied in various forms. Therefore, specific structural and functional details disclosed herein are not to be interpreted as limiting, but merely as a basis for the claims and as a representative basis for teaching one skilled in the art to variously employ the gate lock in virtually and appropriately detailed structure. Further, the terms and phrases used herein are not intended to be limiting; but rather, to provide an understandable description of the invention. While the specification concludes with claims defining the features of the gate lock that are regarded as novel, it is believed that the gate lock will be better understood from a consideration of the following description in conjunction with the drawing figures, in which like reference numerals are carried forward.

Alternate embodiments may be devised without departing from the spirit or the scope of the gate lock disclosed herein. Additionally, well-known elements of exemplary embodiments of the gate lock will not be described in detail or will be omitted so as not to obscure the relevant details of the invention.

Before the gate lock is disclosed and described, it is to be understood that the terminology used herein is for the purpose of describing particular embodiments only and is not intended to be limiting. As used herein, the terms "a" or "an" are defined as one or more than one. The term "plurality," as used herein, is defined as two or more than two. The term "another," as used herein, is defined as at least a second or more. The terms "comprises," "comprising," and any other variation thereof are intended to cover a non-exclusive inclusion, such that a process, method, article, or apparatus that comprises a list of elements does not include only those elements, but may include other elements not expressly listed or inherent to such process, method, article, or apparatus. An element proceeded by "comprises . . . a" does not, without more constraints, preclude the existence of additional identical elements in the process, method, article, or apparatus that comprises the element. The terms "including," "having," and "featuring," as used herein, are defined as comprising (i.e., open language). The terms "coupled" and "attached," as used herein, are defined as connected, although not necessarily directly, and not necessarily mechanically. As used herein, the term "about" or "approximately" applies to all numeric values, whether or not explicitly stated. The terms "about" and "approximately" generally refer to a range of numbers that one of skill in the art would consider equivalent to the recited values (i.e., having the same function or result). In many instances these terms may include numbers that are rounded to the nearest significant figure. Relational terms such as first and second, top and bottom, right and left, and the like, may be used solely to distinguish one entity or action from another entity or action without necessarily requiring or implying any actual such relationship or order between such entities or actions.

Herein various embodiments of the gate lock are described. To avoid redundancy, repetitive description of similar features may not be made in some circumstances. It shall be understood, however, that description of a first-appearing feature applies to the later described similar feature and each respective description, therefore, is to be incorporated therein without such repetition.

As shown in FIG. 1, gate lock 10 attaches to a gate 12. Gate lock 10 can be used with gates of any size. Additionally, gate lock 10 can be used with gates that are single drive or double drive. Further, gate lock 10 can be used with a gate that is next to a building as long as there is a post or other means for mounting the latch bar next to the building. As shown in FIG. 1, gate lock 10 is mounted to first fence portion 14 and second fence portion 15. In one embodiment, gate lock 10 is mounted to first fence portion 14 and second fence portion 15 through use of bolts and lock nuts. First and second fence portions 14 and 15 may be part of a gate, such as the side frame of a gate (the portion of the frame that is opposite the gate hinges), as shown in the Figures. In one embodiment, first fence portion 14 is the side frame of a first gate and second fence portion 15 is part of the side frame of a second gate that is adjacent to the first gate. In another embodiment, one of first or second fence portions 14 or 15 is a post and the other of first or second fence portions 14 or 15 is a part of the side frame of a gate.

Figure 2:
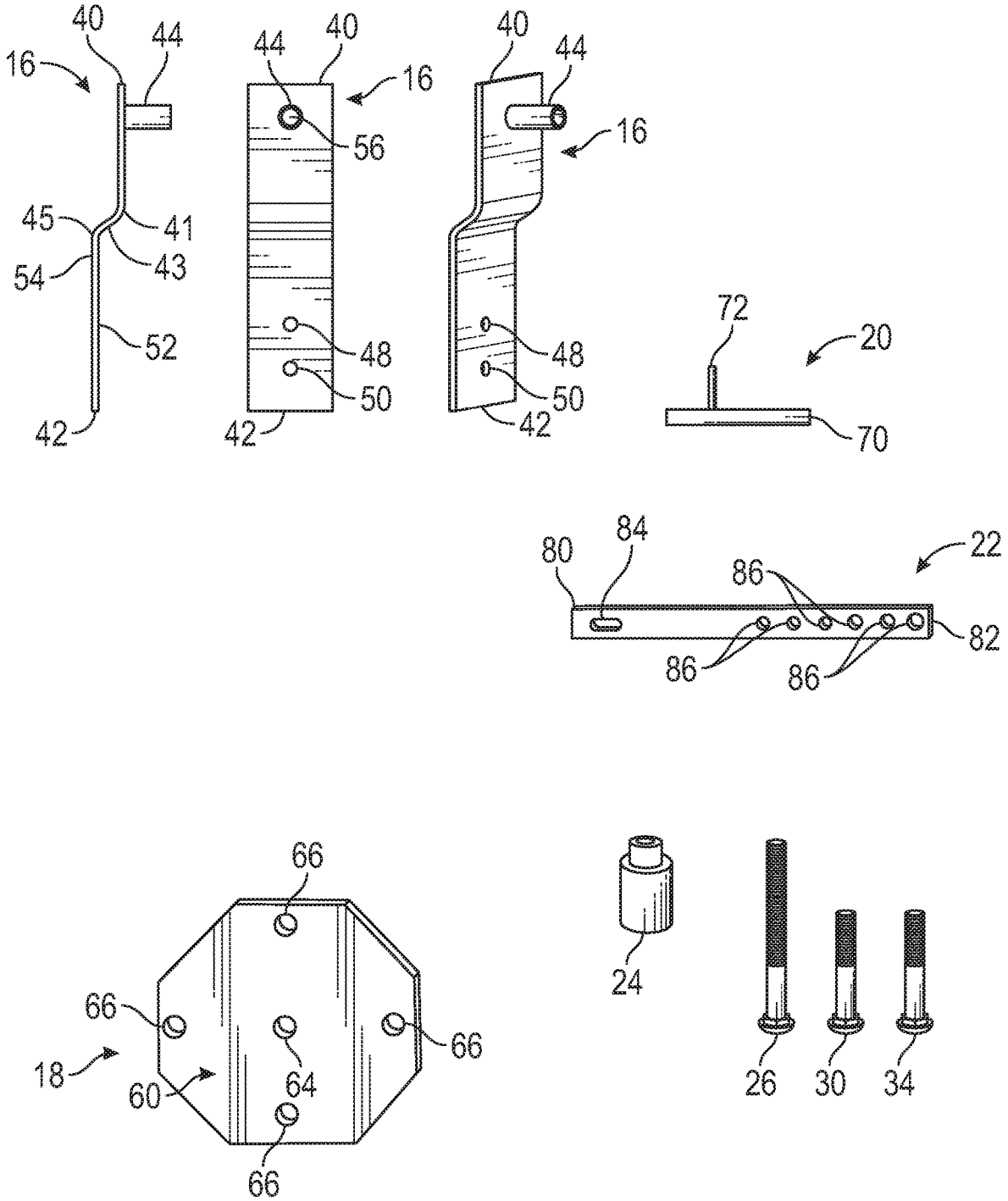
FIG. 2 is a depiction of parts for the gate lock, with the mounting bracket shown from three different angles.

Referring to FIG. 2, gate lock 10 includes mounting bracket 16 (shown from three different angles in FIG. 2), faceplate 18, locking pin 20, and adjustable latch bar 22. Gate lock 10 may be made of any suitable material that is substantially sturdy to perform the functions described herein. In one embodiment, mounting bracket 16, faceplate 18, and adjustable latch bar 22 are each made of stainless steel. In another embodiment, at least one of the following components is made of stainless steel: mounting bracket 16, faceplate 18, adjustable latch bar 22, and locking pin 20. The use of stainless steel increases the integrity of gate lock 10, which prevents break-ins by reducing the likelihood of a person being able to cut the individual components of gate lock 10 to surreptitiously gain access to the locked in area. In another embodiment, at least one of the components of gate lock 10 is made of galvanized metal. In yet another embodiment, at least one of the components of gate lock 10 is made of aluminum.

Figure 4:
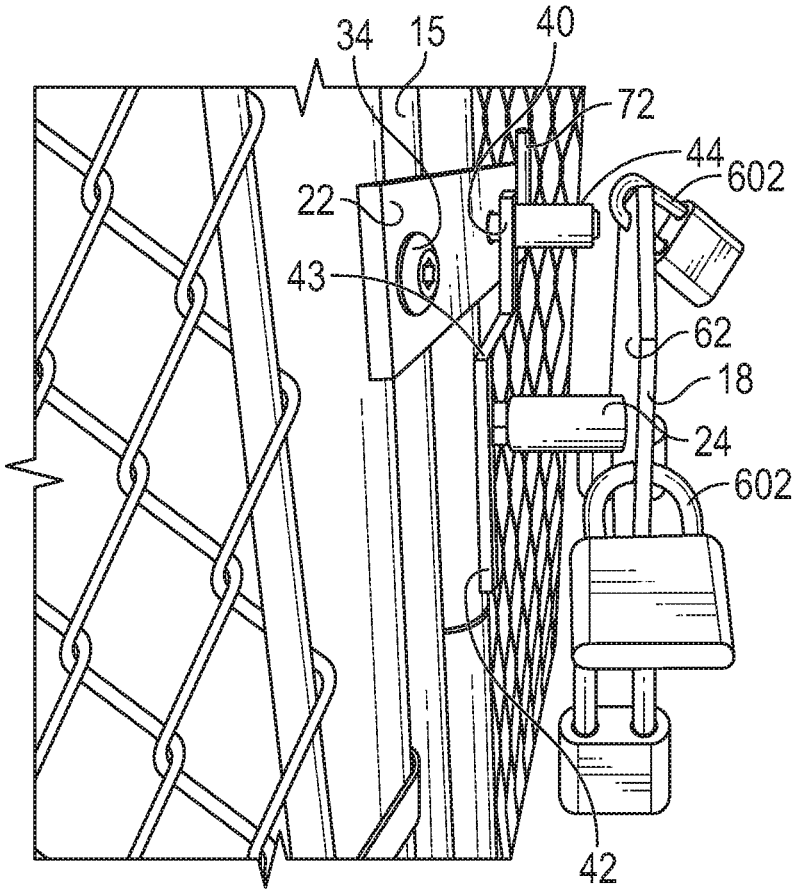
FIG. 4 is a side view of one embodiment of the gate lock.
Figure 5:
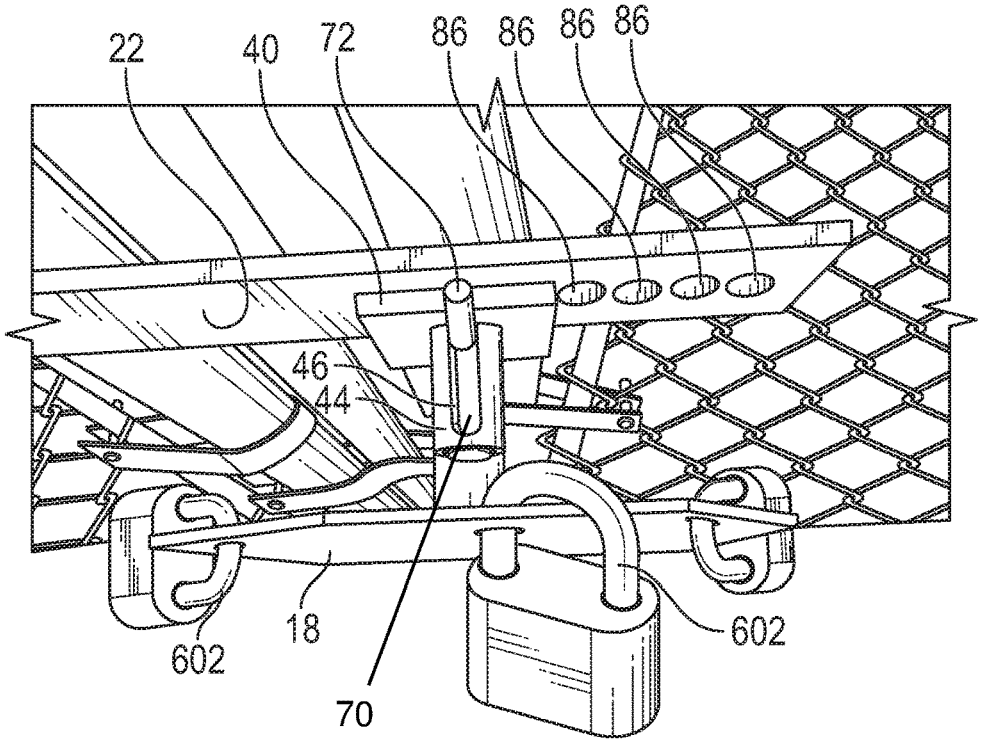
FIG. 5 is a top view of one embodiment of the gate lock.
Figure 6:
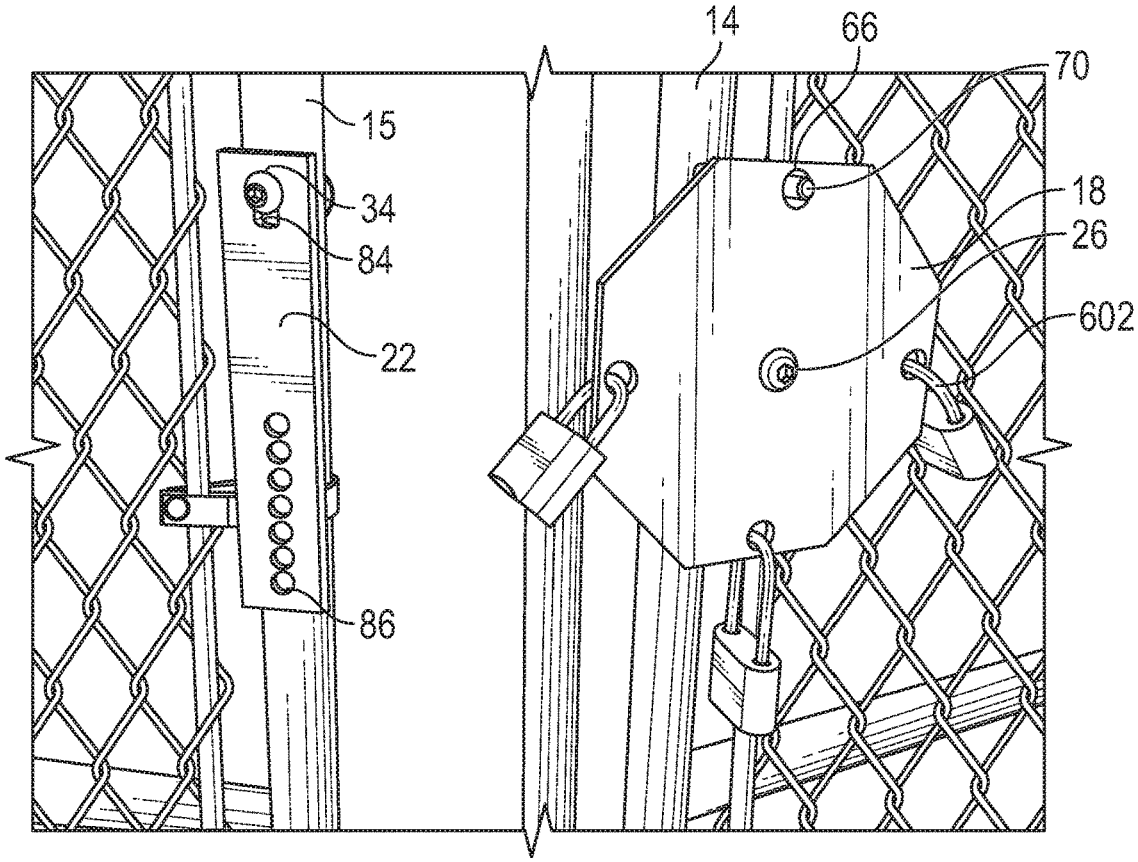
FIG. 6 depicts one embodiment of the gate lock in the unlocked position.
Figure 7:
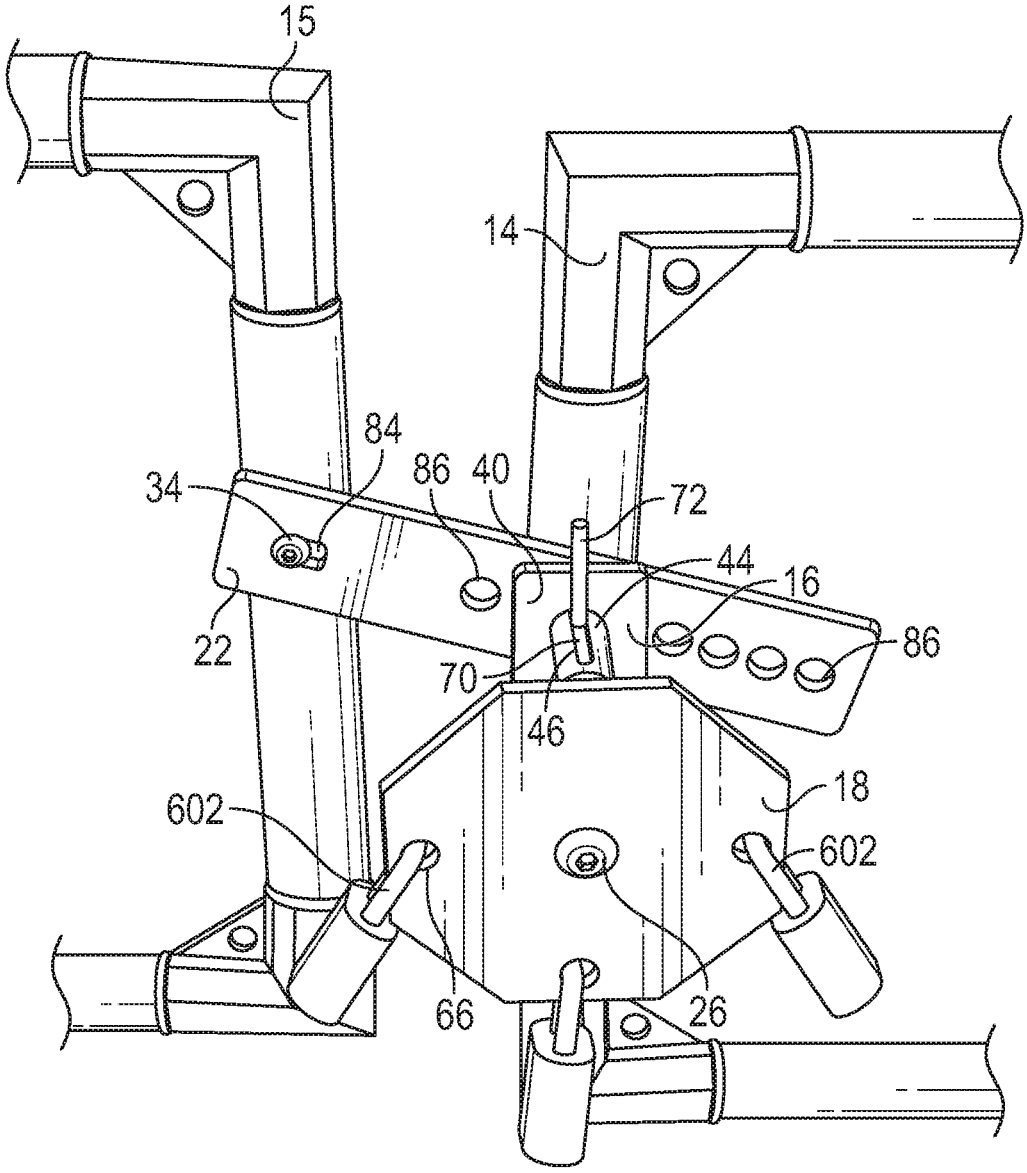
FIG. 7 depicts one embodiment of the gate lock in the locked position with the adjustable latch bar and mounting plate not level with one another.

Still referring to FIG. 2, the mounting bracket 16 has a first end 40 and a second end 42. Mounting bracket 16 also has a front side 52 and a back side 54. A receiver 44 is positioned on first end 40 on front side 52 of mounting bracket 16. As shown in FIGS. 2 and 4, the receiver 44 extends outwards from front side 52 of mounting bracket 16. In one embodiment, receiver 44 has an aperture 56 for slidably receiving pin 70 of locking pin 20. As shown in FIG. 5, in this embodiment, receiver 44 has a slot 46 in which handle 72 of the locking pin is slidably disposed. Slot 46 extends from one end of receiver 44 along at least a portion of the length of receiver 44, such that it is perpendicular to first end 40 of mounting bracket 16. In one embodiment, and as shown in FIG. 5, slot 46 does not extend the entire length of receiver 44. However, in other embodiments, slot 46 may extend the entire length of receiver 44. Receiver 44 may be any shape as long as pin 70 of locking pin 20 is configured to be slidably received in aperture 56 of receiver 44. For example, a non-limiting list of cross-sectional shapes for receiver 44 includes, but is not limited to: circle, rectangle, oval, triangle, and octagon. Slot 46 may be located at any position around the receiver 44. In one embodiment, slot 46 is located on the upper surface of receiver 44 (the portion of receiver 44 that is closest to the top edge of first end 40). In another embodiment, slot 46 is located on the side of the receiver 44. In one embodiment, mounting bracket 16 is approximately the same size as faceplate 18.

As shown in FIG. 2, in one embodiment mounting bracket 16 includes first shoulder 41, angled portion 43, and second shoulder 45. First shoulder 41, angled portion 43, and second shoulder 45 are disposed between first end 40 and second end 42. In a further embodiment, first shoulder 41, angled portion 43, and second shoulder 45 are disposed approximately half-way between first end 40 and second end 42. In one embodiment, first shoulder 41, angled portion 43, and second shoulder 45 are disposed between receiver 44 and aperture 48. Angled portion 43 of mounting bracket 16 is the portion of mounting bracket 16 disposed between first shoulder 41 and second shoulder 45. The angle of angled portion 43 does not matter as long as the lower angle (the angle formed on front side 52 between second shoulder 45 and angled portion 43) and the top angle (the angle formed on the back side 54 between first shoulder 41 and angled portion 43) are substantially identical, so that the top portion of the mounting bracket 16 is substantially parallel with the bottom portion of the mounting bracket 16. The lower and top angles can even be an approximately 90 degree angles. Angled portion 43 is positioned such that it creates a greater distance between first end 40 of mounting bracket 16 and the first fence portion 14 than the distance between second end 42 of mounting bracket 16 and first fence portion 14. The adjustable latch bar 22 rests on angled portion 43 when gate lock 10 is in the locked position. Therefore angled portion 43 should be positioned such that the distance between the first end 40 of mounting bracket 16 and first fence portion 14 is sufficient for adjustable latch bar 22 to be removably received into the area between first end 40 of mounting bracket 16 and first fence portion 14. In one embodiment, mounting bracket 16 is all one piece. In another embodiment, mounting bracket 16 may include multiple pieces attached to each other through means known in the art, such as through bonding, adhesives, fasteners, or welding. In one embodiment, mounting bracket 16 is made by cutting a metal bar, drilling holes in the metal bar, and then bending the metal bar to a desired angle.

Figure 3:
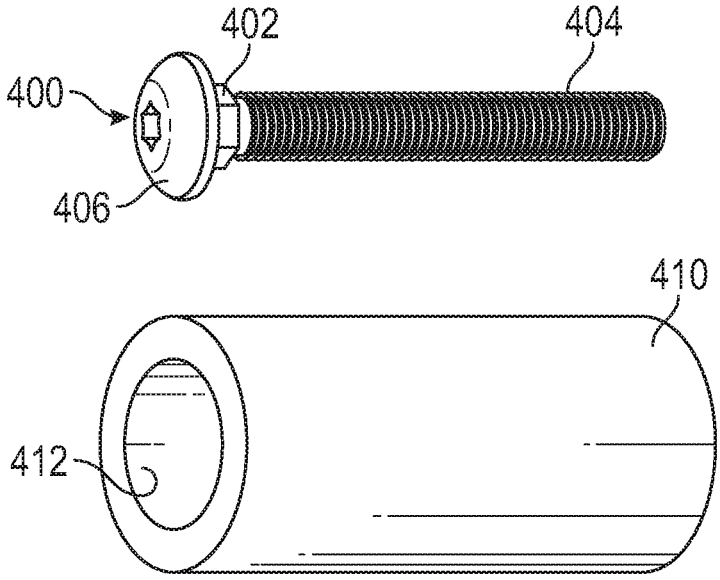
FIG. 3 is a depiction of parts used in an alternate embodiment of the gate lock.

Still referring to FIG. 2, mounting bracket 16 also includes aperture 48 for mounting faceplate 18 to mounting bracket 16. Faceplate 18 may be connected to mounting bracket 16 through the use of a fastener as long as the fastener allows free rotation of faceplate 18 about the fastener. In one embodiment, fastener holds the faceplate 18 close to receiver 44 so that faceplate 18 and receiver 44 are partly touching, but not snug, as this would interfere with the rotation of faceplate 18. In another embodiment, faceplate 18 may not be touching receiver 44 when fastener is used. However, this embodiment may cause faceplate 18 to wobble and may make it more difficult to slide the pin 70 through aperture 66 in faceplate 18. A non-limiting list of fasteners that may be used includes, but is not limited to: screws, bolt, etc. In one embodiment, as shown in FIGS. 1 and 2, faceplate 18 is connected to mounting bracket 16 with bolt 26 and lock nut 28 (not shown). Bolt 26 may be pan (rounded) or a security style, to prevent someone on the outside from loosening the bolt 26. Bolt 26 may be any size as long as it is configured to be received in aperture 48 of mounting bracket and aperture 64 of faceplate 18. In one embodiment, bolt 26 may be between approximately 5.5 inches to approximately 8 inches long. In one embodiment, bolt 26 may be approximately ⅜ inch to approximately ½ inch in diameter. As shown in FIG. 4, in one embodiment, a spacer bushing 24 is positioned between the faceplate 18 and mounting bracket 16. The spacer bushing 24 includes an aperture, through which bolt 26 is disposed. The larger external diameter portion of spacer bushing 24 is larger than the diameter of aperture 48 and therefore spacer bushing 24 sits flush against mounting bracket 16. The smaller external diameter portion of the spacer bushing 24 is disposed within aperture 64 of faceplate 18. The smaller external diameter portion of spacer bushing 24 prevents the backside of the head of bolt 26 from pressing into faceplate 18. If bolt 26 is pressed into faceplate 18, it could prevent faceplate 18 from rotating. Spacer bushing 24 maintains a certain distance between mounting bracket 16 and faceplate 18. The distance should be enough so that faceplate 18 may freely rotate while the padlocks 600 are mounted through aperture(s) 66. However, the distance should not be so much that locking pin 20 can slide through adjustable latch bar 22 and allowing adjustable latch bar 22 to be removed without pin 70 being disposed through an aperture 66 in faceplate 18. In one embodiment, bolt 26 is disposed through faceplate 18, spacer bushing 24, mounting bracket 16, and through first fence portion 14. A washer (not shown) and nut (not shown) are then used to secure bolt 26 to the first fence portion 14. Referring to FIG. 3, in another embodiment, the fastener is a carriage bolt 400. The ledge 402 behind the head 406 of the carriage bolt functions in a similar manner to the smaller external diameter portion of the spacer bushing 24 and is disposed through aperture 64 in faceplate 18. Therefore in embodiments where carriage bolt 400 is used, spacer bushing 410 is also used. Spacer bushing 410 has the same external diameter along its entire length and is sized so that the external diameter is larger than the diameter of apertures 48 and 64. Spacer bushing 410 includes aperture 412 extending through spacer bushing 410. The diameter of aperture 412 is sized so that it is capable of receiving the threads 404 of carriage bolt 400. Mounting bracket 16 also includes aperture 50 for fastening mounting bracket 16 to first fence portion 14. Mounting bracket 16 may be connected to first fence portion 14 through the use of any fastener. A non-limiting list of fasteners that may be used includes, but is not limited to: screws, bolts, etc. In one embodiment, as shown in FIG. 1, mounting bracket 16 is connected to first fence portion 14 via bolt 30, which is disposed through aperture 50. In a further embodiment, lock nut 32 (not shown) is used with bolt 30 to connect mounting bracket 16 to first fence portion 14. Bolt 30 may be any size as long as it is configured to be received in aperture 50 of the mounting bracket. In one embodiment, bolt 30 may be approximately 2.5 inches to 3.5 inches long. In one embodiment, bolt 30 may be approximately ⅜ inch to approximately ½ inch in diameter.

Figure 13:
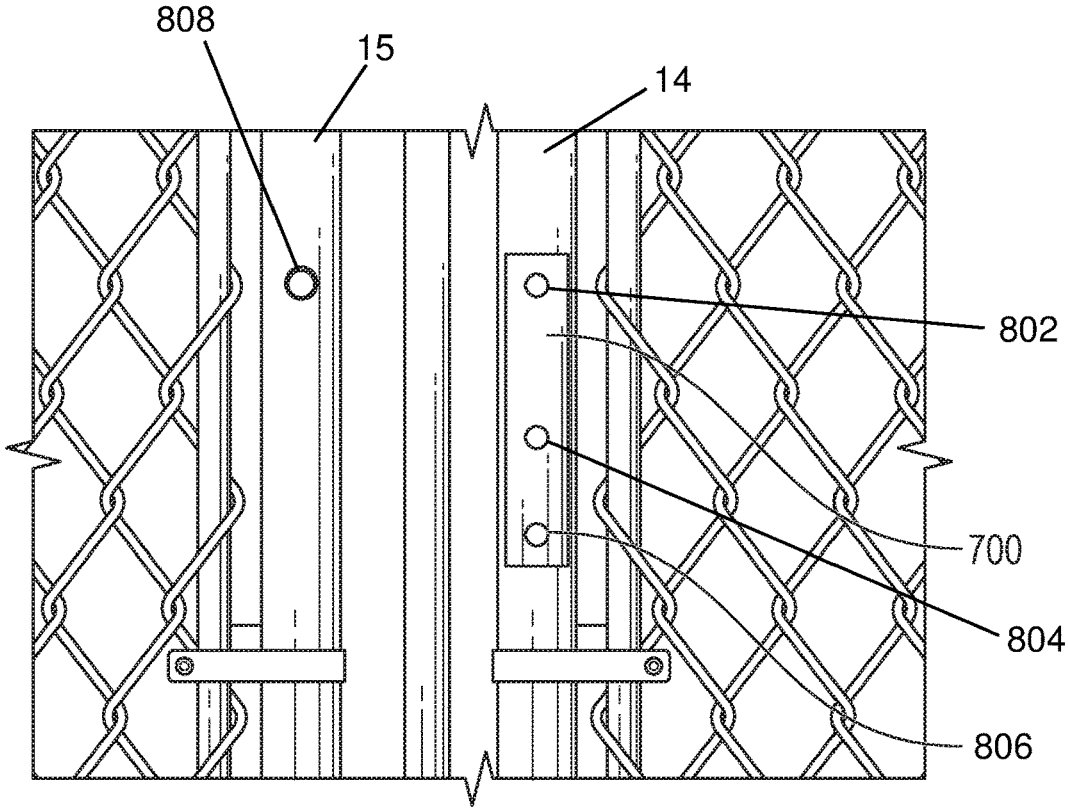
FIG. 13 is depiction of a template for use in installing the mounting bracket on a first fence portion after apertures have been drilled in the position marked by the indicators.

In one embodiment, and as shown in FIG. 2, apertures 48 and 50 are located on the second end 42 of mounting bracket 16. Fasteners, including, but not limited to, screws and bolts, are received in apertures 48 and 50 and through reciprocal apertures, such as aperture 806 in first fence portion 14 (as shown in FIG. 13) to connect mounting bracket 16 to first fence portion 14. In this embodiment, when mounting bracket 16 is connected to first fence portion 14, second end 42 of mounting bracket 16 is connected to first fence portion 14, such that the second end 42 is touching first fence portion 14, and there is a gap between first end 40 of mounting bracket 16 and first fence portion 14. In use, adjustable latch bar 22 is removably received into the gap between first fence portion 14 and first end 40. In other embodiments, mounting bracket 16 has only one aperture for connecting mounting bracket 16 to first fence portion 14. For example, in one embodiment, mounting bracket 16 includes aperture 50, but does not include aperture 48.

Figure 14:
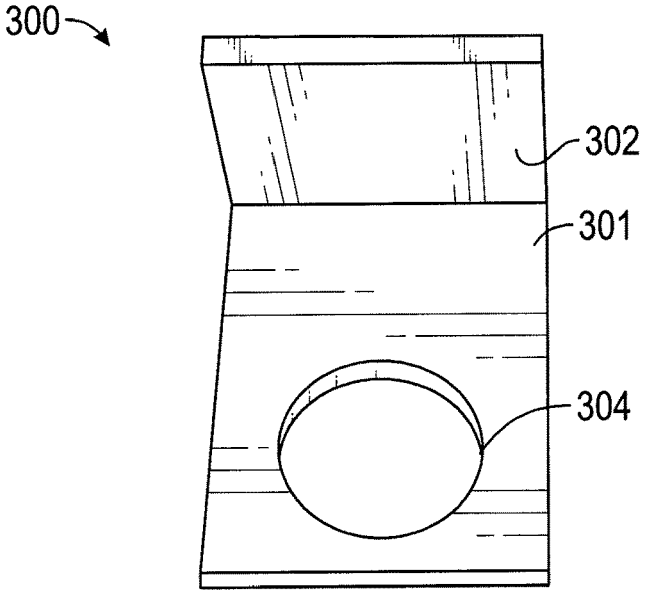
FIG. 14 depicts a cover plate that is used in one embodiment of the gate lock.
Figure 15:
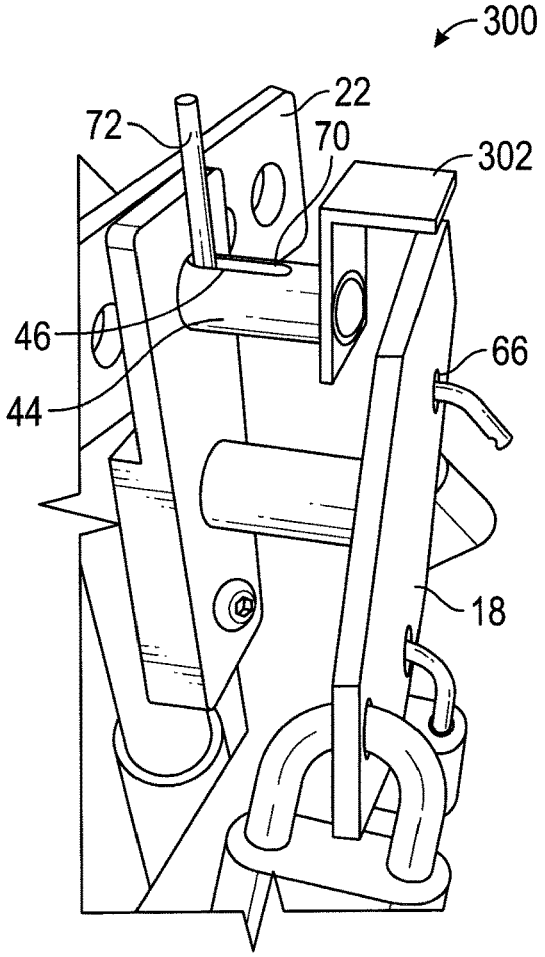
FIG. 15 is a perspective view of an alternate embodiment of the gate lock.

Referring to FIGS. 14 and 15, in one embodiment, receiver 44 has an "L"-shaped latch bar guide 300 mounted to the opposite end of the receiver 44 from the mounting bracket 16. Latch bar guide 300 comprises a plate 301, an extension 302, and an aperture 304. Extension 302 is positioned at an approximate 90° angle in relation to plate 301. Plate 301 includes aperture 304. Aperture 304 is sized so that receiver 44 of mounting bracket 16 is received in aperture 304. In one embodiment, the diameter of aperture 304 is approximately equal to the outer diameter of receiver 44. Extension 302 extends away from receiver 44 and over faceplate 18. Extension 302 prevents the latch bar 22 from being lowered in between the faceplate 18 and the mounting bracket 16. Latch bar guide 300 may be connected to receiver 44 through traditional methods as long as the movement of pin 70 is not obstructed. For example, latch bar guide 300 may be connected to receiver 44 through welding or adhesives. In one embodiment latch bar guide 300 is integrally formed. In other embodiments, extension 302 and plate 301 are connected through traditional methods, including but not limited to welding and adhesives. While latch bar guide 300 is shown as being "L" shaped, in some embodiments, latch bar guide 300 is substantially planar and extends from mounting bracket 16 over the gap between faceplate 18 and mounting bracket 16 so that it prevents latch bar 22 from being lowered in between the faceplate 18 and the mounting bracket 16. In some embodiments, latch bar guide 300 extends over at least a portion of faceplate 18.

Figure 9:
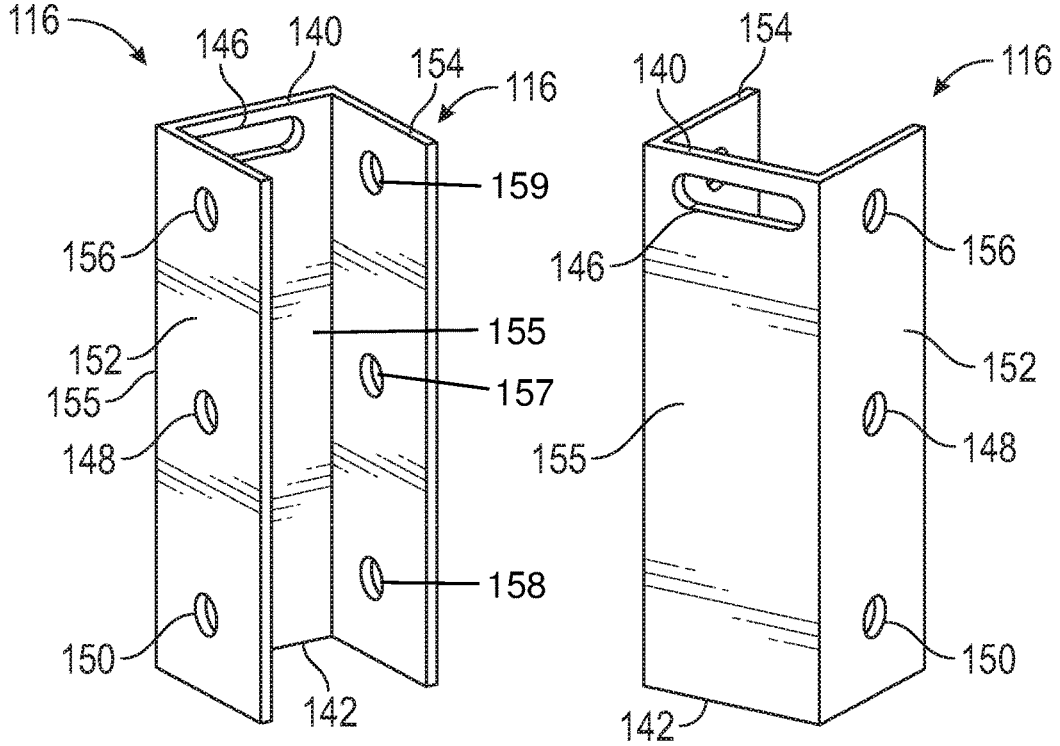
FIG. 9 is a perspective view of an alternate embodiment of the mounting bracket shown from the front and the back.
Figure 10:
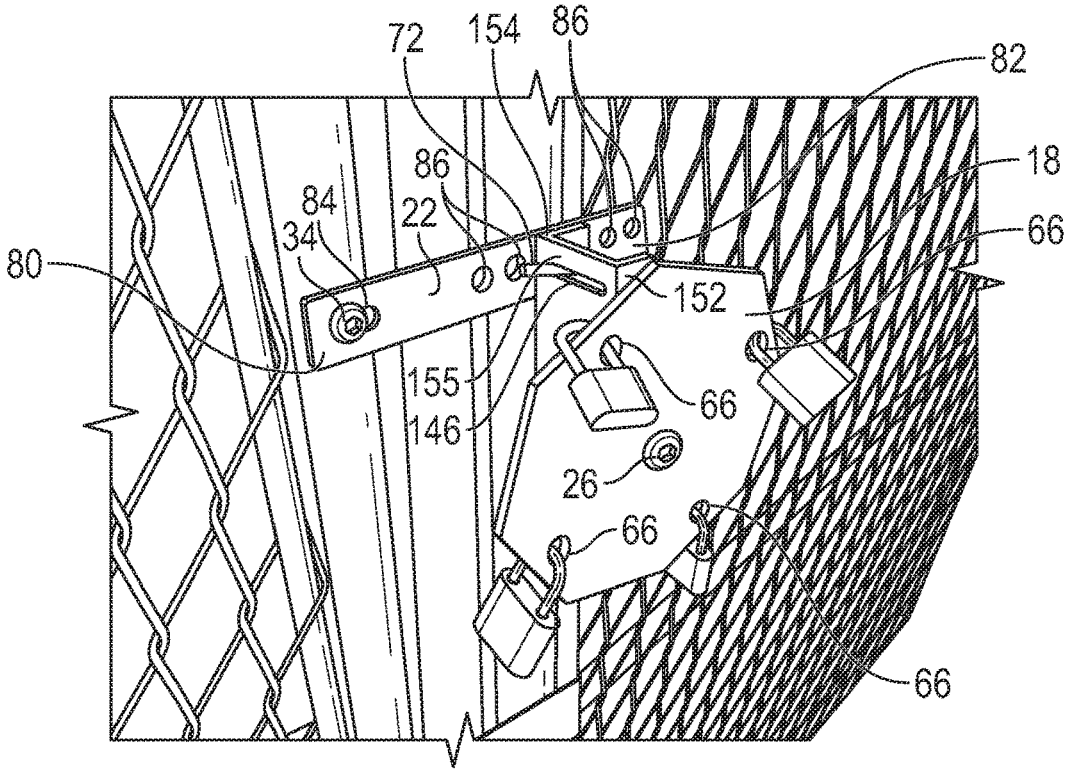
FIG. 10 is a perspective view of an alternate embodiment of the gate lock.

The gate lock 10 may include alternate mounting bracket 116, as shown in FIG. 9. Alternate mounting bracket 116 includes a first end 140, a second end 142, a front plate 152, a back plate 154, and a side plate 155. Front plate 152 and back plate 154 are connected by side plate 155. In one embodiment, front plate 152, back plate 154, and side plate 155 are made from one piece of material. In other embodiments, front plate 152, back plate 154, and side plate 155 are connected through traditional fastening methods, including, but not limited to, adhesives, bonding and welding. Side plate 155 may extend the entire length of the front plate 152 and back plate 154. Front plate 152 includes aperture 156 for slidingly receiving locking pin 20. Front plate 152 includes aperture 148 for connecting mounting bracket 116 to faceplate 18 (as discussed above). In one embodiment, front plate 152 also includes aperture 150 for connecting mounting bracket 116 to first fence portion 14 (as discussed above in reference to mounting bracket 16 to first fence portion 14). Back plate 154 includes aperture 158 for connecting the mounting bracket 116 and first fence portion 14 (as discussed above in reference to mounting bracket 16 to first fence portion 14) and aperture 159 for slidingly receiving locking pin 20. Aperture 158 is positioned approximately opposite from aperture 150 while aperture 159 is positioned approximately opposite from aperture 156. In one embodiment, back plate 154 includes aperture 157 for connecting mounting bracket 116 and faceplate 18 (as discussed above in reference to connecting mounting bracket 16 to faceplate 18). Aperture 157 is positioned approximately opposite from aperture 148. In one embodiment of mounting bracket 116 (shown in FIG. 11), front plate 152 only has apertures 148 and 156 and back plate 154 only has apertures 158, and 159. Side plate 155 includes slot 146 for slidingly receiving handle 72 of locking pin 20. In this embodiment, handle 72 of locking pin 20 remains in aperture 156 at all times. In one embodiment, when connecting mounting bracket 116 to first fence portion 14, a gap at least approximately the same width as the adjustable latch bar 22 remains between back plate 154 and first fence portion 14 so that adjustable latch bar 22 is capable of being removably received between back plate 154 and first fence portion 14.

Figure 8:
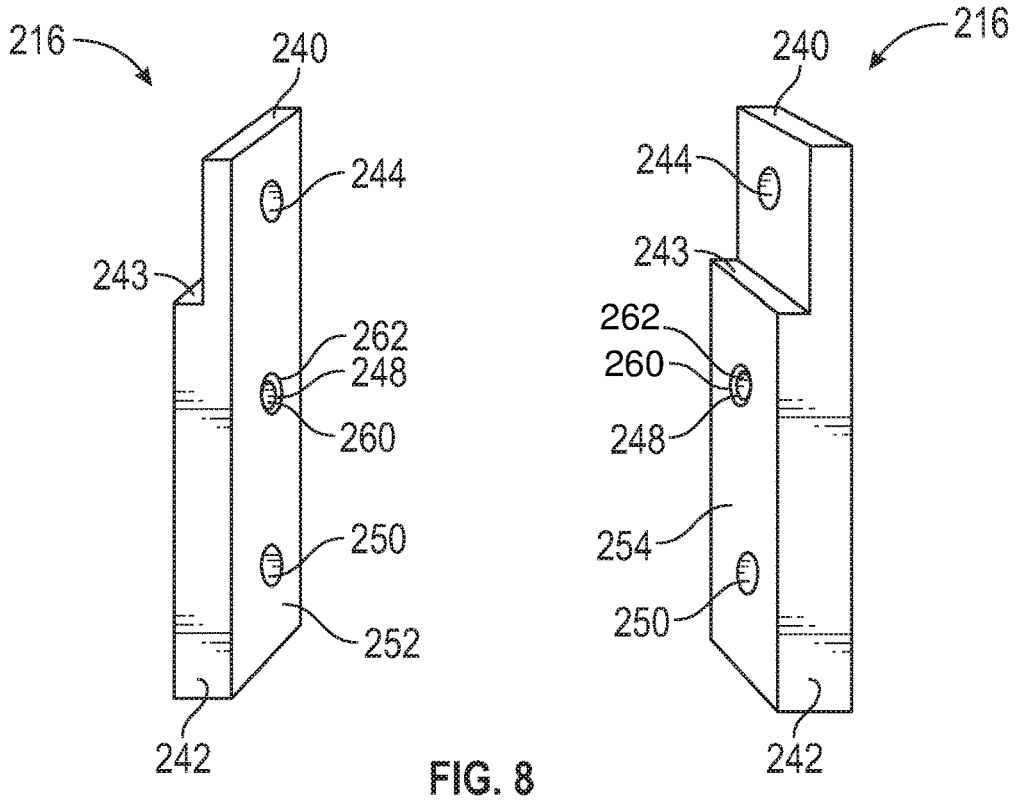
FIG. 8 is a perspective view of an alternate embodiment of the mounting bracket shown from the front and the back.

Gate lock 10 may include alternate mounting bracket 216, as shown in FIG. 8. Alternate mounting bracket 216 includes first end 240, second end 242, front side 252, and back side 254. Alternate mounting bracket 216 has an approximately L-shaped side profile, as shown in FIG. 8. In one embodiment, mounting bracket 216 is approximately 2 inches wide and approximately 6 inches long. First end 240 is narrower than second end 242, creating shelf 243. In one embodiment, first end 240 is approximately ½ inch thick and second end 242 is approximately 1 inch thick. In one embodiment, shelf 243 is approximately perpendicular to the back side 254 of first end 240. In one embodiment, shelf 243 is sized such that it is approximately the same width as adjustable latch bar 22. In another embodiment, shelf 243 is sized such that it is approximately 20% to approximately 40% wider than adjustable latch bar 22 to accommodate the first and second fence portions 14 and 15 being out of line with one another. First end 240 includes aperture 244 for slidingly receiving locking pin 20. Mounting bracket 216 further includes aperture 248 on second end 242, through which a fastener is disposed for connecting the faceplate 18 to the mounting bracket 216 as described above in reference to mounting bracket 16. As described above, faceplate 18 must be able to rotate about the fastener. In one embodiment (shown in FIG. 8), aperture 248 is milled out on the back side 254 of mounting bracket 216 so that aperture 248 has a larger diameter portion 260 positioned adjacent to back side 254 and a smaller diameter portion 262 positioned adjacent to front side 252. Larger diameter portion 260 allows for a nut (not shown) to be recessed into aperture 248 and abut smaller diameter portion 262, which allows the mounting bracket 216 to remain flush with first fence portion 14 to which it is mounted. The diameter of larger diameter portion 260 is sized such that it is capable of receiving spacer bushing 24 or spacer bushing 410. Smaller diameter portion 262 is sized such that it is capable of receiving a fastener, such as bolt 26 or carriage bolt 400. Bolt 26 (or carriage bolt 400) is disposed through the faceplate 18, the spacer bushing 24 (or spacer bushing 410), the mounting bracket 216, and through first fence portion 14. A washer (not shown) and nut (not shown) are then used to secure the bolt 26 (or carriage bolt 400) to first fence portion 14. Aperture 250 is also disposed on second end 252. Mounting bracket 216 is connected to first fence portion 14 through a fastener disposed through aperture 250 (as discussed above in reference to mounting bracket 16 connecting to first fence portion 14). In one embodiment, the fastener is bolt 30, shown in FIG. 2.

Referring to FIGS. 2 and 4, faceplate 18 includes a front side 60, a back side 62, aperture 64, and at least one aperture 66. While faceplate 18 is shown in FIG. 2 as an octagon, faceplate 18 may be any shape, including, but not limited to, a circle, triangle, square, rectangle, star, oval, etc. Faceplate 18 can be any size as long as its weight is capable of being supported by mounting bracket 16 or any of the alternate designs for the mounting bracket (such as mounting bracket 116 or 216). In one embodiment, faceplate 18 is between approximately 6 inches to approximately 10 inches in diameter. In one embodiment, faceplate 18 is between approximately ¼ inch and approximately ¼ inch in thickness. Faceplate 18 is connected to mounting bracket 16 via aperture 64. In one embodiment, aperture 64 is located approximately at the mid-point of faceplate 18. As described above, faceplate 18 is connected to mounting bracket 64 such that faceplate 18 is free to rotate about the fastener disposed through aperture 64. Faceplate 18 also includes at least one aperture 66. Aperture(s) 66 are sized such that they are capable of removably receiving the pin 70 of locking pin 20. Aperture(s) 66 are also sized such that they are capable of removably receiving the locking arm 602 of a padlock 600 when pin 70 is not disposed within aperture 66. Aperture(s) 66 are each disposed on faceplate 18 at approximately the same distance away from aperture 64. The distance between aperture 64 and each aperture 66 is approximately the same distance between apertures 48 and 56 in mounting bracket 16 (or apertures 156 and 148 in mounting bracket 116 or apertures 244 and 248 in mounting bracket 216). In one embodiment, faceplate 18 includes a plurality of apertures 66. In one embodiment, faceplate 18 includes at least two apertures 66. In another embodiment, faceplate 18 includes at least four apertures 66. In still another embodiment, faceplate 18 includes at least eight apertures 66. In still another embodiment, faceplate 18 includes sixteen apertures 66.

Gate lock 10 can be made in different sizes to accommodate differing numbers of padlocks 600. The larger the outer perimeter of faceplate 18, the more padlocks 600 can be accommodated. A non-limiting example of sizes for faceplate 18 includes approximately 6 inches in diameter or approximately 8 inches in diameter. In one embodiment, faceplate 18 is made from aluminum, is a maximum of approximately 6 inches in diameter, and accommodates up to eight padlocks 600. In another embodiment, gate lock 10 includes an approximately 8 inch diameter faceplate 18 made of stainless steel which can accommodate up to sixteen padlocks 600. Practically any shape may be used for faceplate 18 as long as all the apertures 66 are approximately the same distance from aperture 64 of faceplate 18 so that all apertures 66 will align with the locking pin 20 when faceplate 18 is rotated.

Referring to FIG. 2, locking pin 20 includes a pin 70 and handle 72. Pin 70 has a first end 74 and a second end 76. Pin 70 may be any shape, so long that it is capable of being received in aperture 56 of mounting bracket 16 and aperture(s) 86 of the adjustable latch bar 22. Pin 70 should be at least long enough to be disposed through aperture 56 and aperture(s) 86 at the same time. In one embodiment, pin 70 is approximately 2⅝ inches long and approximately ⅜ inch in diameter. The longer pin 70 is, the longer receiver 44, spacer bushing 24, and bolt 26 would have to be. In one embodiment, handle 72 extends perpendicularly away from pin 70. Handle 72 can be any size or shape as long as it is capable of being slidingly received into slot 46. In one embodiment, handle 72 is approximately ⅛ inch to approximately ¼ inch in diameter and approximately 1 inch to approximately 2 inches in length. Handle 72 is disposed on pin 70 so that: when handle 72 is used to slide the pin 70 to its farthest point away from faceplate 18 (when handle 72 abuts mounting bracket 16) faceplate 18 is capable of rotating and the padlocks 600 are capable of passing by the pin 70 unhindered; and when handle 72 is used to slide pin 70 to so that the pin 70 is touching the faceplate 18 (when pin 70 touches faceplate 18 but is not disposed within one of apertures 66) pin 70 is still disposed through aperture 86 in the latch bar 22, thereby preventing the gate from being opened without removing at least one padlock 600. Handle 72 can be integrally formed with pin 70 or it can be attached to pin 70, such as by welding or through a threaded attachment.

Adjustable latch bar 22 includes first end 80, second end 82, aperture 84, and at least one aperture 86. Adjustable latch bar 22 can be any size or shape as long as it is capable of being removably received in the gap between first fence portion 14 and first end 40 of mounting bracket 16. In one embodiment, latch bar 22 is approximately 10 inches long, approximately 2 inches tall, and approximately ¼ inch thick. The thickness of latch bar 22 is determined by the space on the backside of mounting bracket 16 that is going to receive latch bar 22. In one embodiment, there is enough space on the backside of mounting bracket 16 so that latch bar 22 can fit in the space even if the first and second fence portions 14 and 15 are not evenly aligned. In one embodiment, as shown in FIG. 2, adjustable latch bar 22 is rectangular. Aperture 84 is disposed on the first end 80 of adjustable latch bar 22. Referring to FIG. 1, adjustable latch bar 22 mounts to second fence portion 15 via a fastener disposed through aperture 84. A non-limiting list of fasteners that may be used includes, but is not limited to: screws, bolts, etc. In one embodiment, adjustable latch bar 22 is connected to second fence portion 15 via bolt 34, which is disposed through aperture 84, such that adjustable latch bar 22 is capable of rotating about bolt 34. In a further embodiment, lock nut 36 (not shown) is used with bolt 34 to connect adjustable latch bar 22 to second fence portion 15. Bolt 34 may be any size as long as it is configured to be received in aperture 84. In one embodiment, bolt 34 may be approximately 2.5 inches to 3.5 inches long. In one embodiment, bolt 34 may be approximately ⅜ inch to approximately ½ inch in diameter. In another embodiment, bolt 34 may be approximately 6 inches to approximately 8 inches long and approximately ½ inch to approximately 9/16 inch in diameter. In one embodiment, aperture 84 is elongated, as shown in FIG. 2, so that the positioning of adjustable latch bar 22 may be adjusted to accommodate attachment to gates of different distances between first fence portion 14 and first fence portion 15 when in a closed position. Aperture(s) 86 are disposed on second end 82 of adjustable latch bar 22. Aperture(s) 86 are sized so that they can removably receive pin 70 of locking pin 20. In one embodiment, one aperture 86 is disposed on adjustable latch bar 22. In another embodiment, a plurality of apertures 86 are disposed along adjustable latch bar 22. In still another embodiment, apertures 86 are spaced along adjustable latch bar 22 between second end 82 and aperture 84. In still another embodiment, adjustable latch bar 22 includes at least three apertures 86. In yet another embodiment, adjustable latch bar 22 includes at least six apertures 86.

Figure 11:
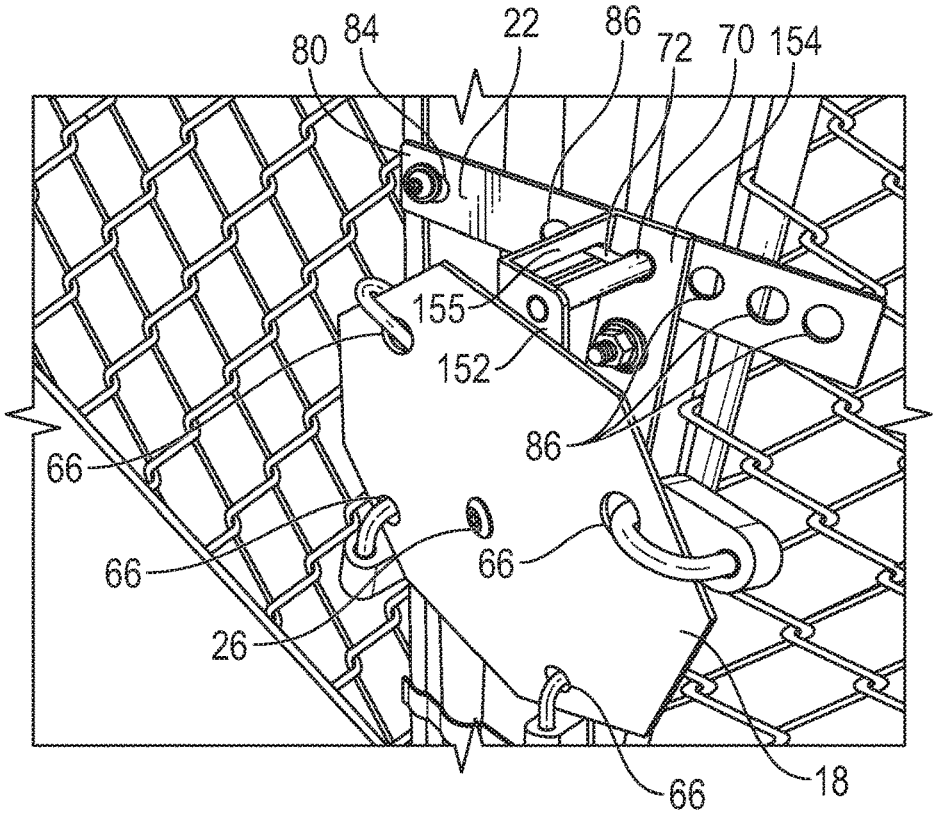
FIG. 11 is a perspective view of an alternate embodiment of the gate lock.
Figure 12:
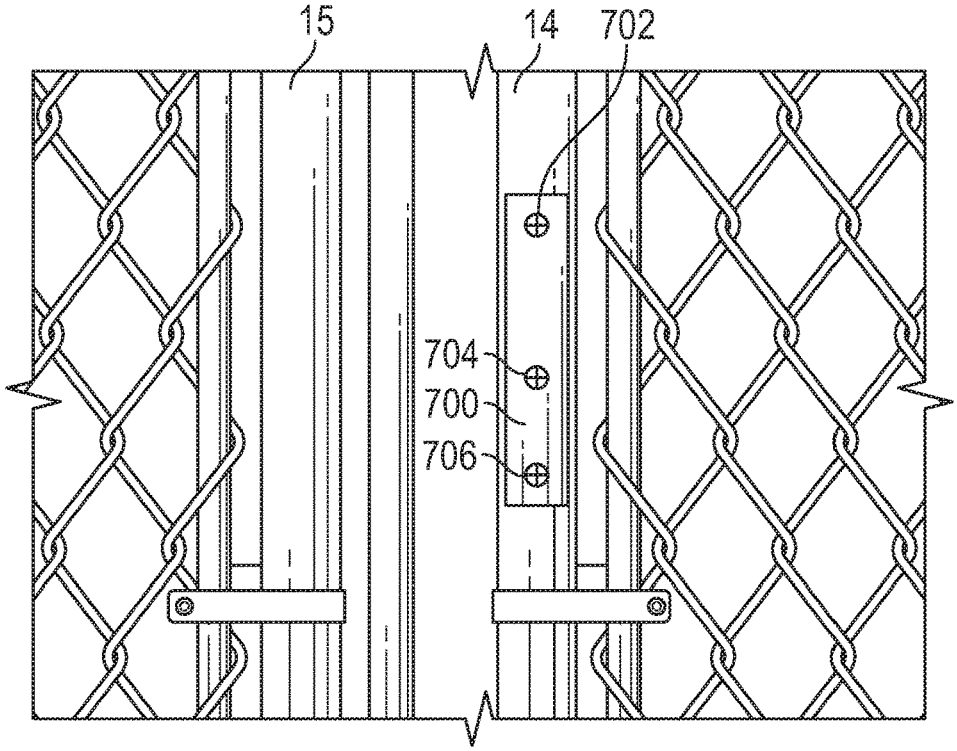
FIG. 12 is a depiction of a template for use in installing the mounting bracket on a first fence portion.

In one embodiment, the mounting bracket 16 and faceplate 18 are shipped to the installer pre-assembled, so that the installer only needs to install mounting 16 bracket and latch bar 22 onto the appropriate fence portions 14 and 15. In another embodiment, mounting bracket 16, faceplate 18, locking pin 20, and various fasteners are not pre-assembled and the installer must assemble them. As shown in FIGS. 12 and 13, in one embodiment, the gate lock 10 system includes a template 700 for no-mistake drilling of apertures 802, 804, and 806 in first fence portion 14. Template 700 includes the proper aperture spacing as shown by indicators 702, 704, and 707 for the three apertures 802, 804, and 806 used for connecting mounting bracket 16 to first fence portion 14. Indicator 702 indicates the positioning of aperture 802 to be created in first fence portion 14 for receiving pin 70. Indicator 704 indicates the positioning of aperture 804 to be created in first fence portion 14 for receiving a fastener (such as bolt 26) that connects faceplate 18 to mounting bracket 16 and first fence portion 14. Alternatively, aperture 804 in first fence portion 14 receives a fastener to only connect mounting bracket 116 to first fence portion 14 (as shown in FIG. 11). Indicator 706 indicates the positioning for aperture 806 to be created in first fence portion 14 for receiving a fastener (such as bolt 30) to connect mounting bracket 16 to first fence portion 14. Indicators 702, 704, and 706 may be an indicator printed onto template 700, as shown in FIG. 12. Alternately, indicators 702, 704, and 706 may be cut-out sections in template 700. In one embodiment, template 700 may be made of vinyl and has an adhesive for sticking to the first fence portion 14. The installer places template 700 on the first fence portion 14 in the location and/or height at which the installer finds most comfortable or practical for the gate lock 10 to be located. In one embodiment, the installation height is around the height of the installer's chest or face. The installer would then drill holes as indicated on by indicators 702, 704, and 706 on template 700. After drilling apertures 802, 804, and 806 as indicated by indicators 702, 704, and 706, the installer would drill aperture 808 on second fence portion 15 at approximately the same height/level as aperture 802. Aperture 808 receives a fastener to secure latch bar 22 to second fence portion 15. Aperture 802 is only drilled through the front, template side of the first fence portion 14 and not all the way through the first fence portion 14. Apertures 804 and 806 are drilled through both the front and back side of the first fence portion 14. After apertures 802, 804, and 806 are drilled, template 700 may be removed and discarded. Then bolt 24 is placed through apertures 64, 48, and 804 and loosely secured with a nut on the backside of the first fence portion 14. Bolt 24 should remain loose until the other components are installed to allow mounting bracket 16 to be moved as needed to align the bottom aperture 50 with aperture 806 in the first fence portion 14. After installing bolt 30 through aperture 50 of mounting bracket 16 and aperture 806 of first fence portion 14, the installer should align aperture 802 in the first fence portion 14 with the locking pin 20 to ensure that locking pin 20 may freely slide in and out of aperture 802. Then, the nuts for bolts 24 and 30 are tightened down to secure mounting bracket 16 to first fence portion 14. Then, latch bar 22 is installed on second fence portion 15 using bolt 34 and a nut. Latch bar 22 should be installed so that it is loose enough to be rotated and maneuvered up and down about bolt 34. The slack can be maintained by using an additional locknut to tighten against the first locknut. Latch bar 22 is secured with locking pin 20. Then, padlock 600 is installed into each of apertures 66 in faceplate 18.

Gate lock 10 is designed to prevent a user from locking other users out of a fenced-in area, yet still keep the fenced-in area secure. A user would remove padlock 600 for which they have a key or combination from one of apertures 66 on faceplate 18. Then, the user would rotate faceplate 18 such that the now empty aperture 66 (from which padlock 600 was just removed) is aligned with locking pin 20. The user would then grip handle 72 on locking pin 20 and move handle 72 toward faceplate 18, thereby causing pin 70 of locking pin 20 to slide into aperture 66. This also results in pin 70 being removed from aperture 86 on adjustable latch bar 22. Then the user would lift adjustable latch bar 22, rotating the latch bar 22 about the fastener 34 in aperture 84. The gate is now capable of being opened.

To relock the gate, the user would exit the gate, and close the gate. The user would then lower the adjustable latch bar 22 so that one of the apertures 86 are adjacent with aperture 56 in mounting bracket 16. The user would then grip handle 72 of locking pin 20, and move handle 72 towards mounting bracket 16, resulting in the removal of pin 70 from aperture 66. This also results in pin 70 sliding into aperture 86 of adjustable latch bar 22. The user would then rotate faceplate 18 so that aperture 66 (from which pin 70 was removed) is no longer aligned with pin 70. User would then place their padlock 600 through aperture 66. As long as all apertures 66 contain a locked padlock 600, the gate lock will remain locked.

Certain embodiments of the gate lock disclosed herein are an improvement over other gate locks available because they are capable of being mounted on gates with different sized posts and with different gate configurations. These gate locks are also easy to install and use. In one embodiment, only four holes need to be drilled for installation of the gate lock onto the posts (three holes in one post in which bolts will be used and the fourth hole in a second post for the pin to slide through). The gate lock can be installed with basic tools. In one embodiment, only three tools are required for installing the gate lock—a drill with a drill bit, wrench (an Allen wrench, an open end wrench, or a crescent wrench), and a ratchet with a socket. Unlike other gate locks, the gate lock disclosed herein is not mounted on the fence cross-brace, which allows the gate lock to be installed at almost any height to accommodate the user's preference. Additionally, in one embodiment, the gate lock is lighter than other gate locks.

Most fenced compounds have double drive gates for vehicle and wide equipment entry, while many driveways have a single long gate; the gate lock described herein will work with both. In one embodiment, the gate lock can be used on a single drive gate (a single gate with a post on either side). In one embodiment, the gate lock can be used on double drive gates (two gates that are side by side that meet in the middle). When the gate lock is used on double drive gates, the adjustable latch bar is mounted to one of the gates while the mounting bracket is attached to the other.

In some cases, the gate could be located in a remote area where there is not easy access to a hospital, which could be an issue if someone allergic to wasps and/or spiders needs to gain entrance to the gate. In one embodiment, the gate lock does not have any cavities or openings in which insects, such as wasps, or spiders could inhabit. This could prevent an unwanted sting or bite from wasps, spiders, or other insects.

The gate lock also prevents a user from locking another user out of the gate. Once installed, the gate lock's components are not detached from gates and therefore cannot be misplaced by a user because a user will only remove their assigned padlock. Additionally, with the gate lock, a chain is not needed—this means that chains do not need to be fed through small fence openings and therefore there is no chain to get short from being cut due to lockouts. The gate lock can easily be opened or closed with one hand if needed, which helps the user if they need to carry equipment into the gated area or if they have a physical disability. In the gate lock, the padlock is the "weakest-link," not the gate lock itself, distinguishing the gate lock from other locking systems that use chains, hasps, and latches.

Many embodiments of the gate lock are also able to secure a gate even if the gates get out of line, such as if the gate is no longer in line with the other gate or with a post. The positioning of the multiple holes on the latch bar allows for tolerance if the gates are out of line with each other. The spacing between the mounting bracket and the adjustable latch bar also allows for tolerance if the gates are out of line with each other. The gate lock works properly with most gate "gaps" and even unleveled gates (including but not limited to gates that are leaning or gates that are no longer lined up, either horizontally, vertically, or both, with each other). A gate gap is the space between, or distance between, two gates or a gate and a post (if it is a single drive gate).

In some embodiments, the gate lock may be permanently installed to prevent theft of the gate lock locking system. Examples of how the gate lock may be permanently installed include, but are not limited to, the use of industrial lock nuts, thread locking liquids such as Loctite™, bending the end of the bolts over after installation of the gate lock, and welding of some of the gate lock components onto the gate and/or posts. In other embodiments, the gate lock includes a template to assist in installation of the gate lock.

The invention claimed is:

1. A gate locking apparatus comprising:

a) a mounting bracket, including:
   i) a lower portion fixedly attachable to a first gate or gate post;
   ii) an upper portion adapted to receive a latch bar; and
   iii) a mounting bracket aperture through said mounting bracket in said upper portion;
   iv) wherein said mounting bracket is adapted to slidably support a locking pin such that it is slidable through said mounting bracket aperture;

b) a faceplate, including a plurality of locking apertures, wherein said face plate is connectable to said mounting bracket in a spaced relationship with said mounting bracket and in a plane substantially parallel to a plane of said first gate and positioned such that said locking apertures are alignable with said mounting bracket aperture of said mounting bracket;

c) a latch bar, including:
   i) a first portion pivotally connectable to a second gate or gate post;
   ii) a second portion extending from said first portion and including at least one locking pin aperture which is alignable with said mounting bracket aperture when said mounting bracket is attached to said first gate or gate post; and d) a locking pin, having a first end and a second end, said locking pin being slidably positionable in said mounting bracket substantially perpendicular to said faceplate and said first gate or gate post and adapted to be movable between i) a locked position wherein said first end extends through said mounting bracket aperture and is engaged with said locking pin aperture of said latch bar and said second is not engaged with said locking aperture of said faceplate, and ii) an unlocked position wherein said second end is aligned with and engages one of said locking apertures of said faceplate and said first end is not engaged with said locking pin aperture of said latch bar;

e) wherein said plurality of locking apertures in said faceplate are configured to accommodate a locking arm of a plurality of locks, such that when said locking arms occupy all of said locking apertures in said faceplate, said locking pin is blocked from disengaging from said locking pin aperture of said latch bar and said gate locking apparatus remains locked.

2. The gate locking apparatus of claim 1, wherein said faceplate is rotatable with respect to said mounting bracket.

3. The gate locking apparatus of claim 2, wherein said faceplate further comprises a central aperture and said locking apertures are radially spaced from said central aperture, and wherein said gate locking apparatus further comprises a fastener rotabably connectable at one end to said central aperture and fixedly connectable at its opposite end to said mounting bracket.

4. The gate locking apparatus of claim 1, further comprising at least one lock adapted to be positioned so as to prevent at least one said locking aperture from engaging with said locking pin.

5. The gate locking apparatus of claim 1, wherein said locking pin further comprises a handle extending from said locking pin between said first and second ends.

6. The gate locking apparatus of claim 3, further comprising a spacer bushing positioned on said fastener between said faceplate and said mounting bracket.

7. The gate locking apparatus of claim 1, wherein said latch bar is provided with a plurality of said locking pin apertures.

8. The gate locking apparatus of claim 1, wherein said latch bar is adapted such that its position is slidably adjustable with respect to the point of pivotal connection with said second gate or gate post.

9. The gate locking apparatus of claim 7, wherein said latch bar is adapted such that its position is slidably adjustable with respect to the point of pivotal connection with said second gate or gate post.

10. The gate locking apparatus of claim 1, wherein said faceplate includes an outer perimeter and said locking aperture is positioned inside said outer perimeter.

11. The gate locking apparatus of claim 1, wherein said faceplate has a planar surface and said locking aperture is formed through said planar face.

12. The gate locking apparatus of claim 1, wherein said latch bar is pivotally connectable to said second gate or gate post by way of an elongated aperture formed in said latch bar.

13. A fence system having a gate locking apparatus locking a first gate or gate post to a second gate or gate post, the gate locking apparatus comprising:

a) a mounting bracket, including:

i) a lower portion fixedly attached to the first gate or gate post;

ii) an upper portion adapted to receive a latch bar; and iii) a mounting bracket aperture through said mounting bracket in said upper portion;

iv) wherein said mounting bracket is adapted to slidably support a locking pin such that it is slidable through said mounting bracket aperture;

b) a faceplate, including a plurality of locking apertures, wherein said face plate is connectable to said mounting bracket in a spaced relationship with said mounting bracket and positioned such that said locking aperture is alignable with said mounting bracket aperture of said mounting bracket;

c) a latch bar, including:

i) a first portion pivotally connected to the second gate or gate post;

ii) a second portion extending from said first portion and including at least one locking pin aperture which is alignable with said mounting bracket aperture when said mounting bracket is attached to said first gate or gate post; and d) a locking pin, having a first end and a second end, said locking pin being slidably positionable in said mounting bracket substantially perpendicular to said faceplate and adapted to be movable between i) a locked position wherein said first end extends through said mounting bracket aperture and is engaged with said locking pin aperture of said latch bar and said second is not engaged with said locking aperture of said faceplate, and ii) an unlocked position wherein said second end is aligned with and engages one of said locking apertures of said faceplate and said first end is not engaged with said locking pin aperture of said latch bar;

e) wherein said plurality of locking apertures in said faceplate are configured to accommodate a locking arm of a plurality of locks, such that when said locking arms occupy all of said locking apertures in said faceplate, said locking pin is blocked from disengaging from said locking pin aperture of said latch bar and said gate locking apparatus remains locked.

* * * * *